US005325771A

United States Patent [19]

Morris

[11] Patent Number: 5,325,771

[45] Date of Patent: Jul. 5, 1994

[54] OIL FILTER CRUSHING APPARATUS AND METHOD

[76] Inventor: Drew W. Morris, P.O. Box 10111, Greenville, S.C. 29603

[21] Appl. No.: 55,504

[22] Filed: Apr. 29, 1993

Related U.S. Application Data

[63] Continuation-in-part of Ser. No. 737,969, Jul. 30, 1991, abandoned.

[51] Int. Cl.[5] ..... B30B 9/06; B30B 13/00; B30B 9/32

[52] U.S. Cl. ..... 100/37; 100/39; 100/98 R; 100/126; 100/131; 100/245; 100/902

[58] Field of Search ..... 100/35, 37, 39, 98 R, 100/126, 131, 218, 245, 902; 222/83, 87

[56] References Cited

U.S. PATENT DOCUMENTS

| | | | |
|---|---|---|---|
| 2,616,477 | 11/1952 | Scheer et al. | 100/902 |
| 2,958,273 | 11/1960 | Morrow | 100/98 R |
| 3,872,785 | 3/1975 | Elliott | 100/98 R |
| 3,993,221 | 11/1976 | Boynton et al. | 100/98 R |
| 4,291,618 | 9/1981 | Heiser et al. | 100/902 |
| 4,334,469 | 6/1982 | Tanner et al. | 100/902 |
| 4,771,686 | 9/1988 | Triantos, Jr. | 100/902 |
| 5,048,413 | 9/1991 | Deiters | 100/902 |
| 5,060,564 | 10/1991 | Buford et al. | 100/902 |
| 5,125,331 | 6/1992 | Wood | 100/902 |

*Primary Examiner*—Stephen F. Gerrity
*Assistant Examiner*—Reginald L. Alexander
*Attorney, Agent, or Firm*—Hardaway Law Firm

[57] ABSTRACT

An oil filter crushing apparatus and method utilizing a housing defining an interior space and a bottom surface, a crushing member fitted within the housing having a crushing surface and defining a slot opening through the crushing surface, a puncturer having a point and movably attached to the crushing member within the slot opening so that the puncturer is behind the crushing surface in a retracted position and at least the point of the puncturer is forward of the crushing surface in a puncturing position.

20 Claims, 4 Drawing Sheets

OIL FILTER CRUSHING APPARATUS AND METHOD

CROSS REFERENCE TO RELATED APPLICATIONS

This application is a continuation-in-part application from application Ser. No. 07/737,969 now abandoned, filed Jul. 30, 1991.

BACKGROUND OF THE INVENTION

This invention relates generally to the art of crushing articles, and more particularly to the art of crushing oil filters.

There has been a burst of concerns related to the disposal and environmental impact of used oil filters. As a result, interest has turned towards crushing used oil filters in an effort to reduce the volume of the filters being trashed as well as to reduce the amount of free-flowing oil which is present in the filters.

Various apparatuses and methods for crushing oil filters exist. Such oil filter crushers range from pneumatic crushers to electrically controlled hydraulic crushers.

Despite the prior art devices directed towards crushing oil filters, there exists much room for improvement in the art.

SUMMARY OF THE INVENTION

It is thus an object of this invention to provide a novel apparatus and method for crushing oil filters.

It is another object of this invention to provide an apparatus and method for crushing oil filters which can be used to collect multiple crushed oil filters while allowing for drainage of free-flowing oil.

It is a further object of this invention to provide an apparatus and method for crushing oil filters which, after insertion of a filter to be crushed, enables crushing of the filter, collecting of drained oil, and disposal of the crushed filter to occur without touching the filter.

It is still further object of this invention to provide an apparatus and method for crushing oil filters which safely prevents explosions from occurring during crushing.

These as well as other objects are accomplished by an oil filter crushing apparatus comprising a housing defining an interior space for crushing an oil filter, a crushing member for crushing the oil filter fitted within the housing having a crushing surface and defining a slot opening in the crushing surface, a puncturer having a point, the puncturer movably attached to the crushing member within the slot and positioned within the slot behind the crushing surface in a retracted position and the puncturer being in a tilted position with the point being forward of the crushing surface when the puncturer is in a puncturing position, means for forcing the crushing member through the interior space, and means for forcing the puncturer to tilt from the retracted position to the puncturing position as the crushing member moves through the interior space, whereby an oil filter in the interior space can be punctured by the puncturer as the crushing member crushes the oil filter.

Other objects and a fuller understanding of the invention will become apparent from the following description given with reference to the various figures of drawings.

DETAILED DESCRIPTION

In accordance with this invention it has been found that a novel apparatus and method for crushing oil filters is provided. It has also been found that an apparatus and method for crushing oil filters is provided which can be used to collect multiple crushed filters while allowing for drainage of free-flowing oil. It has further been found that an apparatus and method for crushing oil filters is provided which, after insertion of a filter to be crushed, enables crushing of the filter, collecting of drained oil, and disposal of the crushed filter to occur without touching the filter. It has still further been found that an apparatus and method for crushing oil filters is provided which safely prevents explosions from occurring during crushing.

Various other advantages and features will become apparent from a reading of the following description given with reference to the various figures of drawings.

Figure 1:
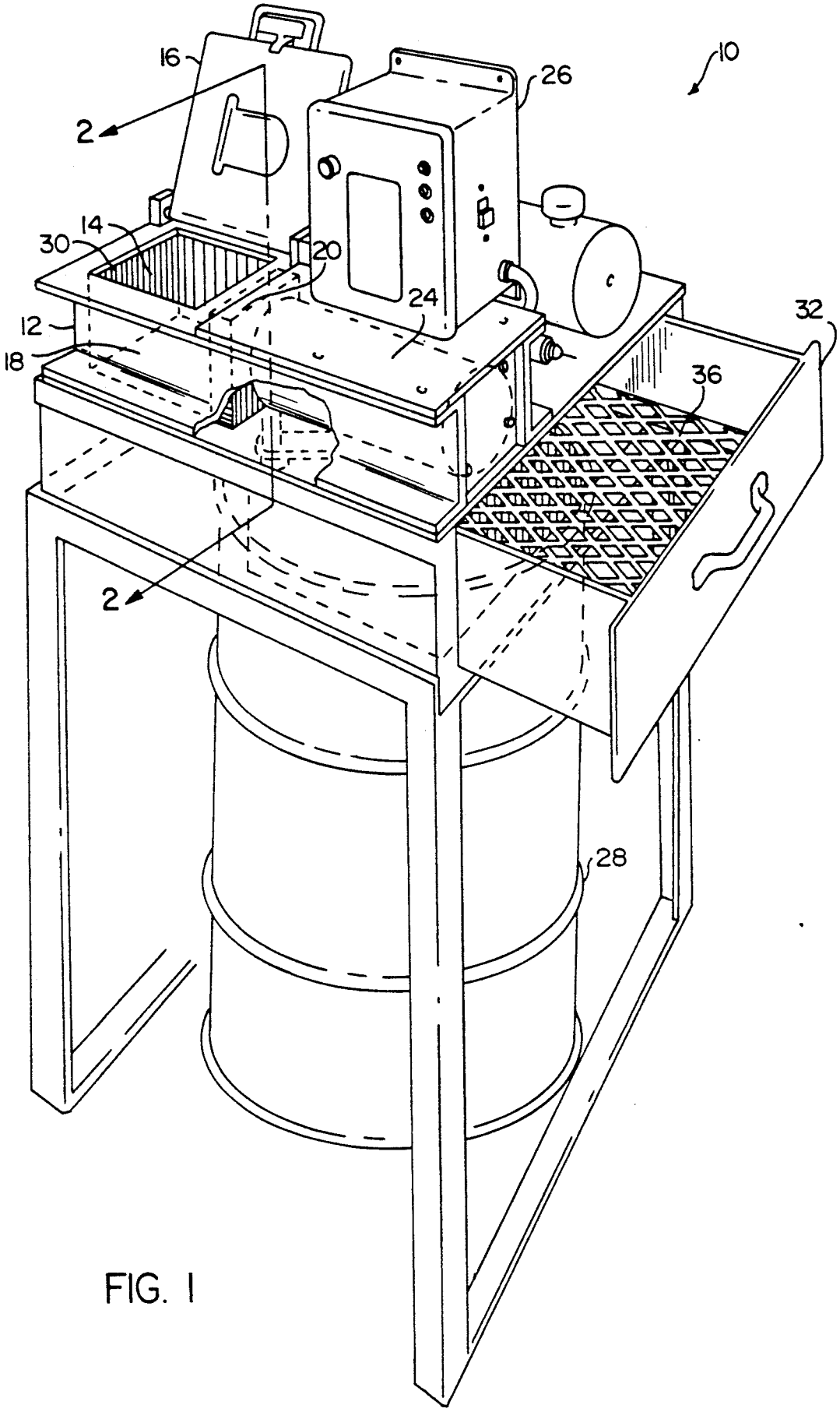
FIG. 1 of the drawings is a perspective view of the oil filter crushing apparatus.

FIG. 1 of the drawings is a perspective view of the oil filter crushing apparatus 10 and illustrates housing 12 which defines an interior space 14 therein for crushing an oil filter. Housing 12 includes a lid 16 for closing off interior space 14 and a bottom surface 18 opposite lid 16. Bottom surface 18 supports an oil filter in position for crushing, however, other walls of housing 12 could be used for supporting an oil filter in position for crushing depending on the horizontal or vertical position of crushing apparatus 10.

A crushing member 20 (best illustrated in FIGS. 2, 3, and 4) is positioned within crushing apparatus 10 and includes a crushing surface 22 for crushing oil filters. Crushing member 20 preferably is designed to fit and move matingly through interior space 14 to effectively crush an oil filter. To forcefully move crushing member 20, an electrically controlled hydraulically driven cylinder 24 is preferably utilized as shown in FIG. 1, although it is envisioned that any conventional means could be used to forcefully move crushing member 20 through interior space 14 to crush an oil filter. Electrical control box 26 is utilized to control the operation of crushing apparatus 10.

Oil filter crushing apparatus 10 is illustrated in FIG. 1 in the preferred embodiment as it is horizontally positioned and is maintained by four legs at a height sufficient for insertion of a 55 gallon drum 28 underneath for collection of oil resulting from crushed oil filters.

Referring still to FIG. 1, it is preferred and envisioned that lid 16 utilizes a rod to be hingedly connected to housing 12. This rod preferably extends to connect and work with electrical controls in control box 26 so that crushing member 20 operates only when lid 16 is in a closed position. When lid is open, the position of the rod is shifted and prevents electrical operation of crushing member 20. This advantageous feature promotes safety while crushing oil filters.

An oil filter to be crushed is inserted into interior space 14 preferably with the top of the oil filter facing compacting surface 22 of crushing member 20. In the horizontal position illustrated in FIG. 1, the oil filter would be supported on bottom surface 18 and crushed by crushing member 20 against end wall 30. For help with orientation, the underside of lid 16 illustrates the proper positioning of an oil filter. It is envisioned that the size of interior space 14 can be adapted to accommodate various sizes of oil filters to be crushed.

Also illustrated in FIG. 1 of the drawings is a drawer 32 that is removably positioned beneath interior space 14 but above drum 28. Drawer 32 functions as a collection chamber for crushed oil filters as they exit interior space 14, preferably through an opening 34 defined by bottom surface 18 of housing 12 which is adjacent to end wall 30. Opening 34 is illustrated in phantom in FIGS. 5 and 6. Drawer 32 preferably comprises a bottom 36 defining a plurality of openings therein that allow oil to drain through drawer 32 and into drum 28.

Figure 4:
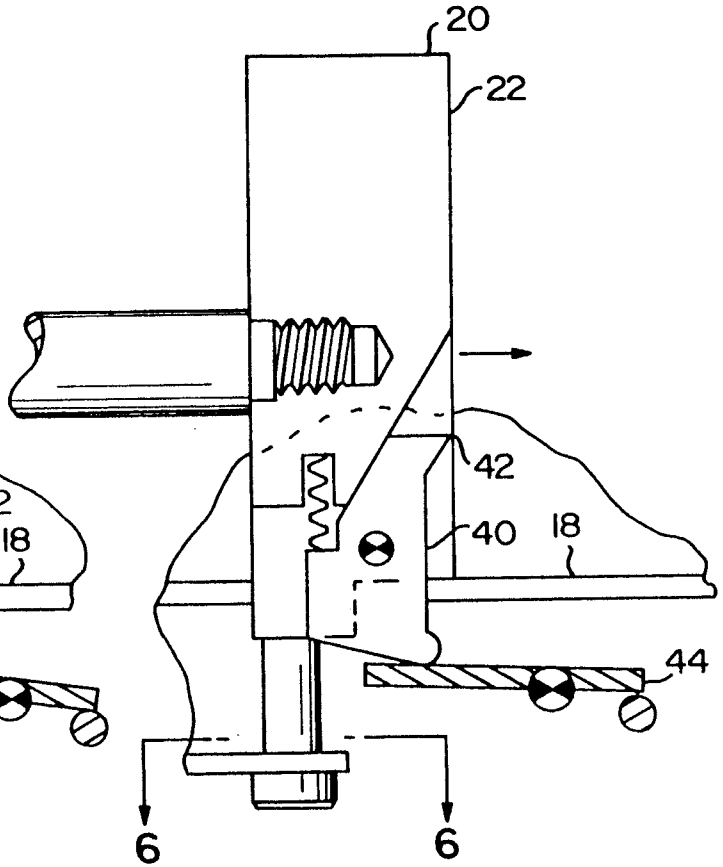
FIG. 4 of the drawings is a cross section view showing progressive movement from FIG. 3.
Figure 5:
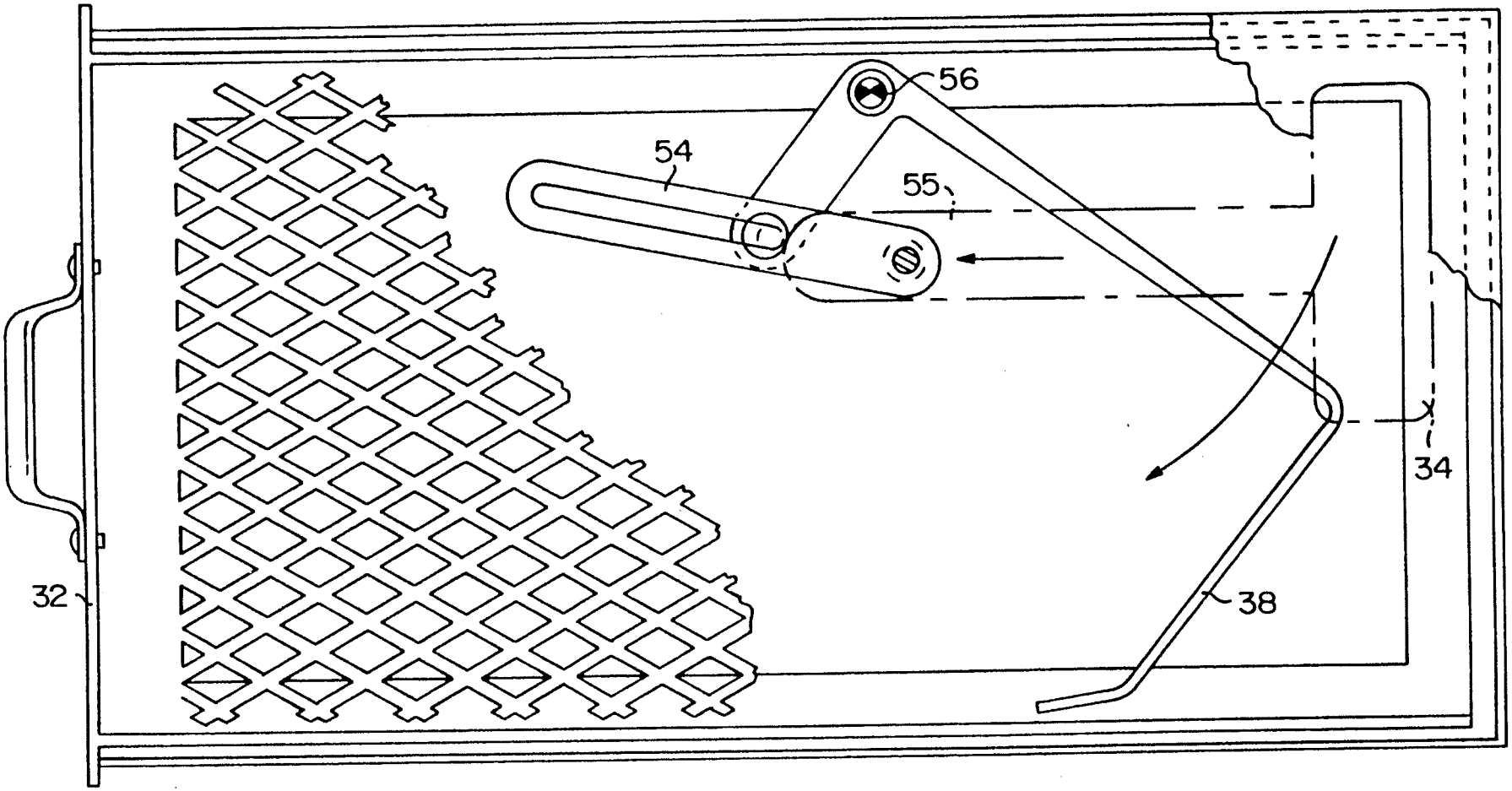
FIG. 5 of the drawings is a cross section view drawn along line 5—5 of FIG. 2.
Figure 6:
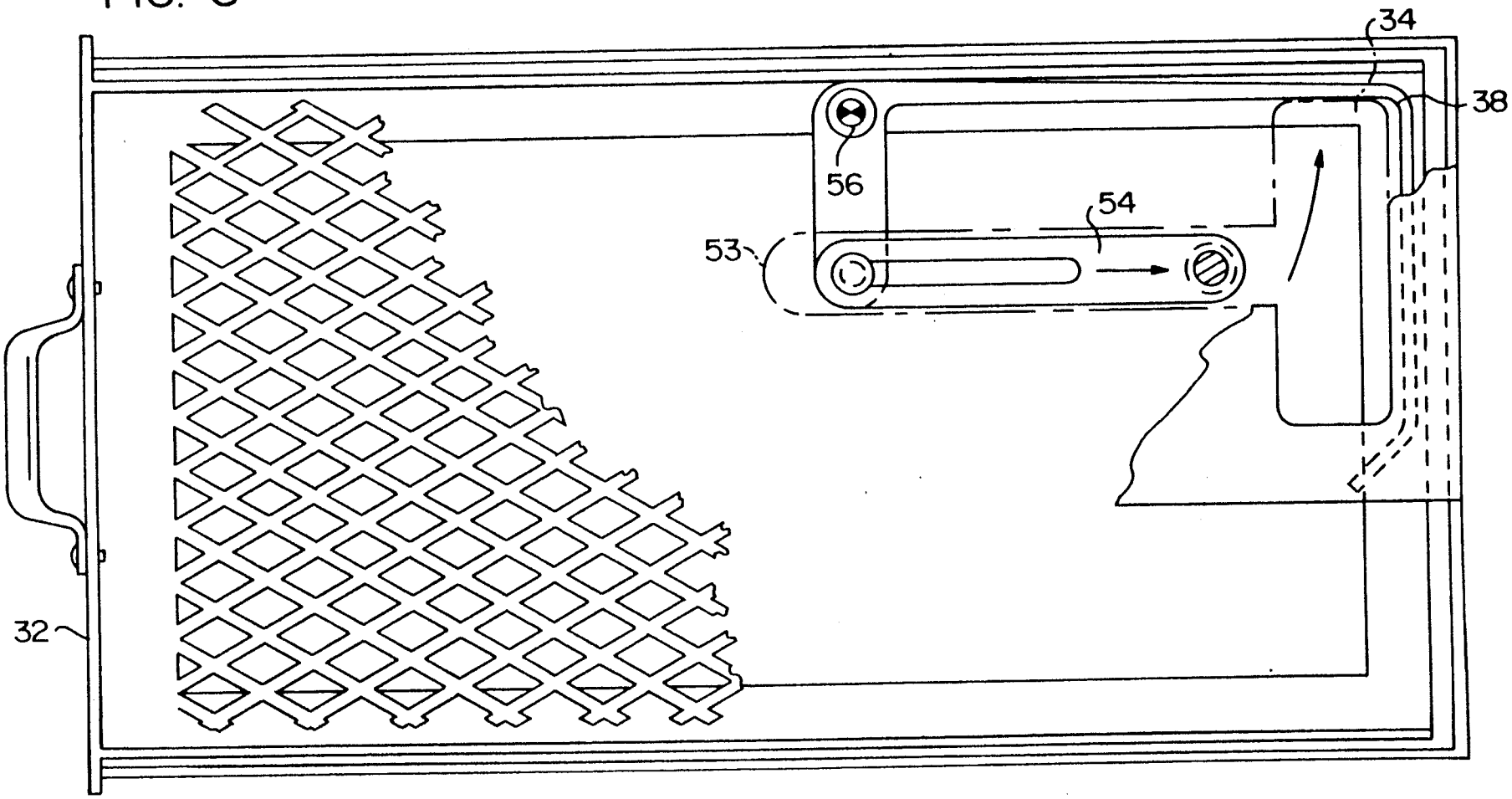
FIG. 6 of the drawings is a cross section view drawn along line 6—6 of FIG. 4.

A sweep arm 38, illustrated in FIGS. 5 and 6, is movably positioned below bottom surface 18 and adapted to sweep crushed oil filters that fall through opening 34. The functioning of sweep arm 38 is best illustrated in FIGS. 2 through 6.

Figure 3:
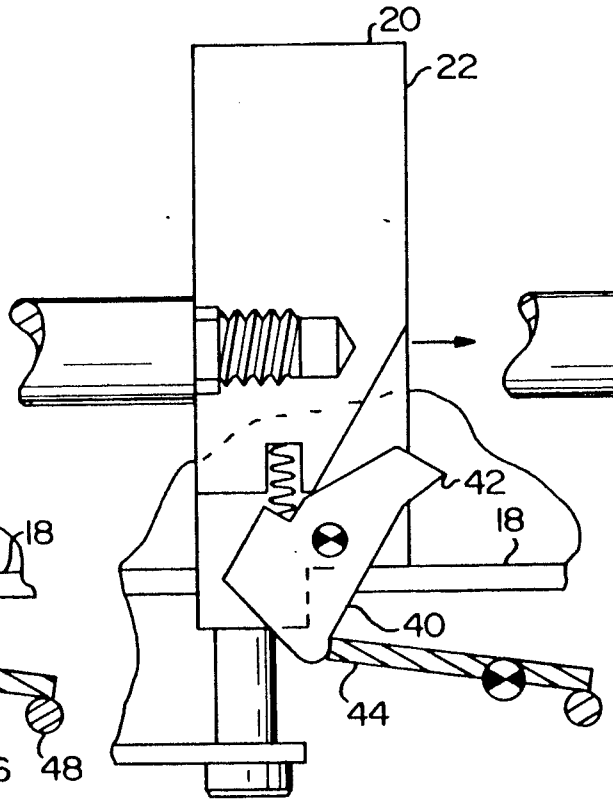
FIG. 3 of the drawings is a cross section view showing progressive movement from FIG. 2.
Figure 2:
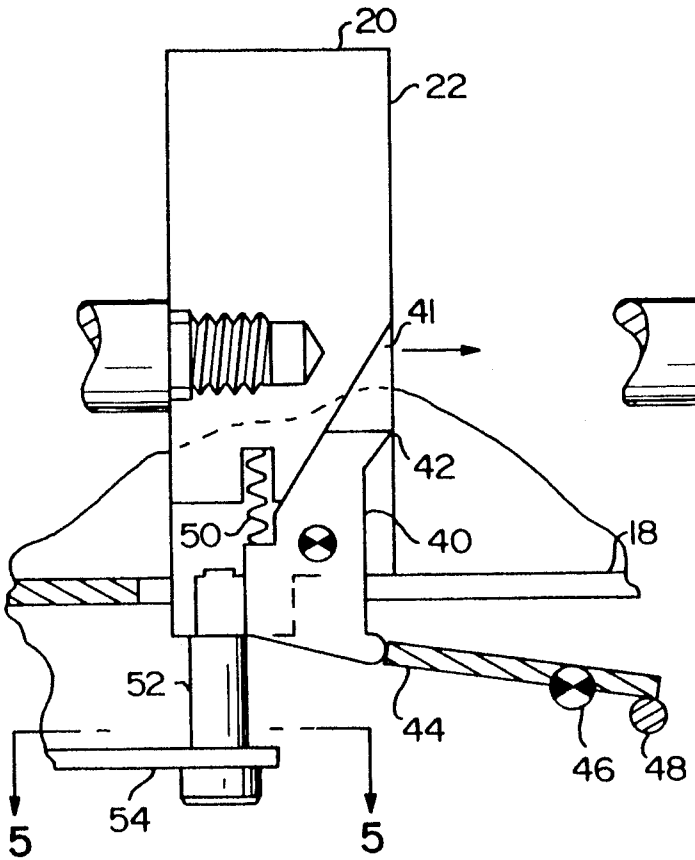
FIG. 2 of the drawings is a cross section view drawn along line 2—2 of FIG. 1.

FIG. 2 is a cross section view drawn along line 2—2 of FIG. 1. FIGS. 2, 3, and 4 illustrate the progressive movement of crushing member 20 as its crushing surface 22 moves towards and crushes an oil filter. As a significant and advantageous feature of this invention, crushing member includes a puncturer 40 movably attached thereto within a vertical slot opening 41 defined within crushing member 20. Puncturing an oil filter to be crushed prevents explosions from occurring during the crushing process. FIGS. 2, 3, and 4 also illustrate the movement of puncturer 40 as crushing member 20 moves to crush an oil filter.

Puncturer 40 includes a point 42 for puncturing an oil filter. It is envisioned that puncturer 40 be of any conventional design useful for puncturing an oil filter. Crushing apparatus 10 includes means for forcing puncturer 40 to puncture an oil filter during the crushing process. Such means could be any conventional means, however, in the preferred embodiment, such means comprises a blocking member 44 pivotally attached within housing 12 below bottom surface 18. Blocking member 44 pivots on and is held in position by a rod 46. A torsion spring can be used to bias blocking member 44 in position on stop 48. When biased against stop 48, blocking member 44 is in proper position to engage puncturer 40 as it moves with crushing member 20 through interior space 14 to crush an oil filter. Upon continued forceful engagement of puncturer 40 with blocking member 44, puncturer 40, which is preferably biased in position by compression spring 50, is forced to tilt from its retracted position in FIG. 2 with point 42 forward of crushing surface 22. Further forceful engagement of puncturer 40 with blocking member 44 causes puncturer 40 to be forced over blocking member 44 as blocking member 44 pivots its position to see-saw away from stop 48, as shown in FIG. 4. This allows puncturer 40 to be pulled by compression spring 50 and return to its retracted position within slot opening 41.

Once the position of crushing member 20 and puncturer 40 shown in FIG. 4 is reached and an oil filter is then crushed, it is envisioned that the electrical controls will automatically retract puncturer 40 to return it to its retracted position and in position to either move to engage blocking member 44 or in a position already engaging blocking member 44 as illustrated in FIG. 2. Crushing apparatus 10 then turns itself off so that to crush another oil filter, the electrical controls must again be activated and lid 16 must be closed.

FIGS. 2, 3, and 4 also partially illustrate means for moving sweep arm 38, illustrated in FIGS. 5 and 6. A bar 52 that is securely attached to and extends from crushing member 20 has a slotted arm 54 pivotally attached thereto. Bar 52 extends beneath surface 18 through a slot 53 defined therein which communicates with opening 34 and is illustrated in phantom in FIGS. 5 and 6. Any oil draining from the crushing of oil filters within interior space 14 can therefore drain through slot 53 as well as through opening 34 of bottom surface 18.

FIGS. 5 and 6 are cross section views drawn along lines 5—5 and 6—6 of FIGS. 2 and 4 respectively. Sweep arm 38 is pivotally attached to slotted arm 54 to allow movement within its slot as sweep arm 38 sweeps a crushed oil filter from beneath opening 34 to allow for more crushed oil filters to fall through opening 34 and be collected in drawer 32. FIG. 5 illustrates sweep arm 38 in a sweeping position, which occurs as puncturer 40 engages blocking member 44 as illustrated in FIG. 2. After the sweeping motion is complete, sweep arm 38 returns to its ready position. In the ready position, sweep arm 38 is positioned to again sweep a crushed oil filter that falls through opening 34. Sweep arm 38 is forced to this ready position as puncturer 40 is pulled over blocking member 44 at the end of the crushing process, as illustrated in FIG. 4. A movable guide such as guide pivot 56 can be utilized for the movement of sweep arm 38.

As oil filters are consecutively crushed, sweep arm 38 consecutively sweeps them away from beneath opening 34 to a distant position for collection within drawer 32. As desired, drawer 32 can be removed and the crushed oil filters can be transferred to another receptacle without ever having to touch the filters.

It is thus seen that the present invention provides a novel oil crushing apparatus and method. It is also seen that the present invention provides an apparatus and method for crushing oil filters which can be used to collect multiple crushed oil filters while allowing for drainage of free-flowing oil. It is further seen that the present invention provides an apparatus and method for crushing oil filters which, after insertion of a filter to be crushed, enables crushing of the filter, collecting of drained oil, and disposal of the crushed filter to occur without touching the filter. It is still further seen that the present invention provides an apparatus and method for crushing oil filters which safely prevents explosions from occurring during the crushing process.

Many variations are apparent to those of skill in the art, and such variations are embodied within the spirit and scope of the present invention as measured by the following appended claims.

I claim:

1. An oil filter crushing apparatus comprising:

a housing defining an interior space for crushing an oil filter and a bottom surface;

a crushing member for crushing the oil filter fitted within said housing having a crushing surface and defining a slot opening through said crushing surface;

a puncturer having a point, said puncturer movably attached to said crushing member within said slot opening, said puncturer positioned within said slot of said crushing member behind said crushing surface when said puncturer is in a retracted position and at least said point of said puncturer being forward of said crushing surface when said puncturer is in a puncturing position;

means for forcing said crushing member through said interior space;

means for forcing said puncturer to tilt from the retracted position to the puncturing position as said crushing member moves through said interior space;

whereby an oil filter in said interior space can be punctured by said puncturer as said crushing member crushes the oil filter.

2. The apparatus according to claim 1 wherein said crushing member is matingly fitted within and movable through said housing.

3. The apparatus according to claim 1 wherein said means for forcing said crushing member comprises an electrically controlled hydraulically driven cylinder.

4. The apparatus according to claim 1 wherein said means for forcing said puncturer comprises a blocking member pivotally attached within said housing below said bottom surface, said blocking member positioned to engage said puncturer as it moves with said crushing member through said housing to force said puncturer into the puncturing position and positioned so as to allow said puncturer to be forced over said blocking member causing said blocking member to pivot and allowing said puncturer to return to its retracted position.

5. The apparatus of claim 1 wherein said bottom surface defines a slotted opening slotted in the direction of movement of said crushing member.

6. The apparatus according to claim 5 wherein a bar is fixedly attached to said crushing member and extends through said slotted opening.

7. The apparatus according to claim 1 wherein said housing defines an opening in said bottom surface for a crushed oil filter to pass.

8. The apparatus according to claim 7 further comprising a collection chamber beneath said interior space for containing crushed oil filters.

9. The apparatus according to claim 8 wherein said collection chamber defines openings to allow oil to pass.

10. The apparatus according to claim 9 wherein said collection chamber is a removable drawer.

11. The apparatus according to claim 1 further comprising a sweep arm positioned beneath said bottom surface and above a bottom of said collection chamber, said sweep arm connected to move in conjunction with said crushing member so as to engage a crushed oil filter and sweep it from beneath said opening defined in said bottom surface.

12. The apparatus according to claim 6 further comprising a sweep arm positioned beneath said bottom surface and connected to said bar by a slotted arm pivotally connected to said bar.

13. The apparatus according to claim 1 wherein said puncturer is maintained in the retracted position by a compression spring.

14. The apparatus according to claim 4 wherein said blocking member is maintained in position to engage said puncturer by a torsion spring.

15. The apparatus according to claim 1 wherein said housing further includes a lid covering said interior space.

16. The apparatus according to claim 15 wherein said lid is hingedly attached to said housing and includes means for preventing operation of said crushing member when said lid is open.

17. A method for crushing oil filters comprising the steps of:

providing an oil filter crushing apparatus comprising, a housing defining an interior space for crushing an oil filter and a bottom surface;

a crushing member for crushing the oil filter fitted within said housing having a crushing surface and defining a slot opening in said crushing surface;

a puncturer having a point, said puncturer movably attached to said crushing member within said slot, said puncturer positioned within said slot of said crushing member behind said crushing surface in a retracted position and said puncturer being in a tilted position with said point being forward of said crushing surface in a puncturing position;

means for forcing said crushing member through said interior space;

means for forcing said puncturer to tilt from the retracted position to the puncturing position as said crushing member moves through said interior space;

whereby an oil filter in said interior space can be punctured by said puncturer as said crushing member crushes the oil filter;

puncturing said oil filter with said puncturer as said crushing member crushes said oil filter;

retracting said puncturer as said oil filter is crushed;

crushing said oil filter.

18. The method of crushing oil filters according to claim 17 wherein said crushing member is automatically retracted to its original position once crushing is complete.

19. The method of crushing oil filters according to claim 17 wherein the oil filter falls into a collection chamber once crushing is complete and further including the step of sweeping the oil filter to another position once inside the collection chamber.

20. The method of crushing an oil filter according to claim 17 further including the step of collecting oil draining from said oil filter as it is crushed.

* * * * *